United States Patent [19]

Strasbaugh

[11] 3,962,832

[45] June 15, 1976

[54] FLUID RESPONSIVE, LEVERAGE OPERATED CHUCK

[75] Inventor: Ray Howard Strasbaugh, Long Beach, Calif.

[73] Assignee: R. Howard Strasbaugh, Inc., Long Beach, Calif.

[22] Filed: Aug. 26, 1974

[21] Appl. No.: 500,530

[52] U.S. Cl. ..... 51/217 L; 269/25

[51] Int. Cl.[2] ..... B24B 41/06

[58] Field of Search ..... 51/217 L, 217 T, 217 S, 51/216 LP, 284; 269/32, 157, 238, 25

[56] References Cited

UNITED STATES PATENTS

| | | | |
|---|---|---|---|
| 930,639 | 8/1909 | Woodruff | 51/217 L X |
| 1,566,003 | 12/1925 | Hill | 51/217 L |
| 1,832,968 | 11/1931 | De Armey | 269/238 X |
| 2,561,819 | 7/1951 | Porter et al. | 269/238 |
| 3,337,210 | 8/1967 | Mayhew | 269/32 X |
| 3,618,271 | 11/1971 | Martiros | 51/216 LP X |
| 3,686,796 | 8/1972 | Clark | 51/284 X |

FOREIGN PATENTS OR APPLICATIONS

| | | | |
|---|---|---|---|
| 507,097 | 11/1951 | Belgium | 51/229 |

*Primary Examiner*—Harold D. Whitehead
*Attorney, Agent, or Firm*—Howard L. Johnson

[57] ABSTRACT

A chuck assembly particlarly useful to position a lap or lens blank at the end of an oscillatory spindle for opthalmic lens grinding; comprises an opposing pair of jaws, one of which is fixed and the other a loosely hanging plate, laterally and longitudinally tiltable between engage and disengage positions by selective action of a fluid-operated piston having a conic contact head which distally abuts the jaw plate for leveraged closing fulcrumed against a workpiece-adjacent edge, in opposition to resilient means biased to hold the jaw open.

6 Claims, 8 Drawing Figures

FLUID RESPONSIVE, LEVERAGE OPERATED CHUCK

BACKGROUND OF THE INVENTION

There are many examples of clamps or chucks used to hold successive workpieces in position for various processing steps. Commonly, such jaws use springs and/or bolts to maintain tension. However, these require time and effort for each manual release and resetting when changing a workpiece. Also, when the fastened workpiece is necessarily subject to operational vibration, this tends to loosen or weaken the permanence of the clamping force, whether produced by springs or screw threads. Accordingly, it would be desirable to have such jaws operative with more certain or constant clamping means which at the same time could be instantly set and realeased as desired. While various vacuum chucks are old, particularly those with pairs of oppositely curved jaws applicable to tubular workpieces, these do not provide the present leveraged clamping applied to a straight edge by a non-hinged, self-aligning tiltable plate jaw and also such past constructions are not adapted to be correlated with the composite operation of an opthalmic polishing or grinding machine. However, use of the present fluid-operated chuck is not limited to association with this particular type of assembly or operation.

BRIEF STATEMENT OF THE INVENTION:

The invention provides a chuck assembly which is instantly and automatically releasable and alternately is effective to securely clamp opposite edges of a workpiece by fluid-applied force exerted in a leveraged manner to the effort arm portion of a loose tiltable jaw plate so as to thereby exert force on a short terminal length of the plate which thus contacts the work. Such movable jaw thus presses the work against an opposing fixed jaw and is loosely hung suspended on four traversing parallel shafts which are disposed in a rectangular pattern. Such chuck is particularly adapted, for example, to position successive workpieces (e.g. a lap) at the top of an oscillating spindle, which is thus disposed in opposition to a frictionally, transverse-sliding, companion workpiece (lens blank) such as are conformingly shaped in opthalmic grinding or polishing machines. Similar fluid pressure applied to the holding jaw assembly may simultaneously be used to exert downpressure upon the opposing workpiece through the overlying positioning arm of such machine; unitary triggering and pressure control means are provided for the dual functions.

Thus the present construction employs a planar jaw plate which is loosely (slidably) carried on four parallel horizontal shafts projecting from a side of the chuck body at the four corners of a theoretical square or quadrangle, the lower pair of shafts carrying coiled springs disposed normally to urge the jaw to an open or disengage position. Located in a transverse bore of the chuck body, generally centered relative to the projecting shafts, is a fluid-responsive piston having a conic head of which the apex or point continually abuts the inner face of the plate. In operation, the tilting jaw plate fulcrums against the inner edges of the flared heads of the upper pair of shafts which heads jointly for a theoretical triangle with the piston which is forced outwardly against the plate, the distance of piston contact from this two-point fulcrum line is much greater than that of the short clamping engagement arm so that considerable leverage may thus be applied by the jaw to the workpiece. Such fluid-maintained force is not diminished or loosened by the continued operational vibration of a lapping or other device. In addition, the movable jaw is self-aligning since the conic head with its one-point contact on the plate makes it unnecessary to ever rotationally align the piston and the loosely suspended jaw can also adjust laterally to accommodate the clamped workpiece edge. If desired, the necessary operating fluid (air or liquid) can be conveyed to the rear face of the piston through the interior of the tubular spindle, and the jaw-contact face of the piston is further shielded from contact with the abrasive lapping slurry. However use of the chuck is not limited to use with such lens-working assemblies; the chuck can also of course be mounted on a stationary support to position any kind of workpiece.

DETAILED DESCRIPTION OF PREFERRED EMBODIMENTS

Figure 1:
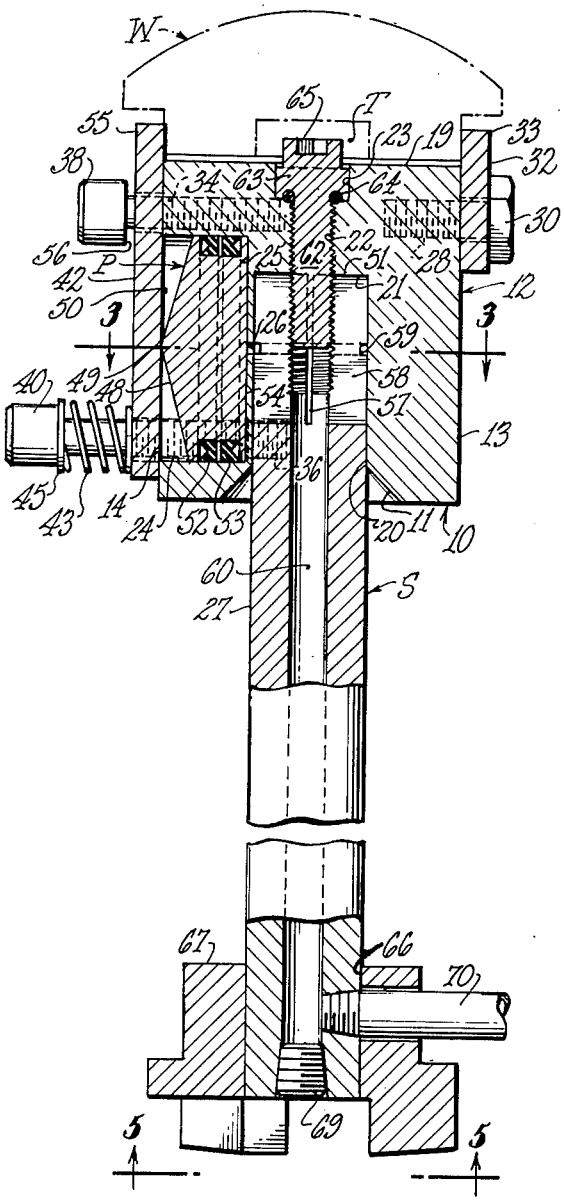
FIG. 1 is a vertical sectional view taken through an example of the present fluid-operated chuck, shown mounted on a tubular spindle or standard, with portions in elevation, a loosely supported workpiece or lap being shown in phantom.
Figure 2:
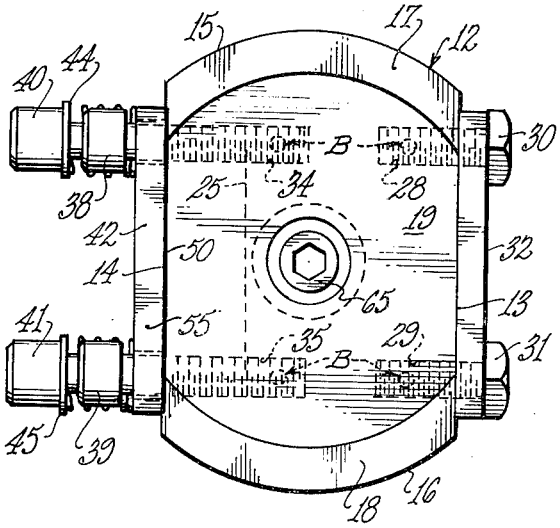
FIG. 2 is a top plan view of the mounted chuck of FIG. 1.

As here illustrated, the body or support member 12 of the chuck is formed with an opposite pair of parallel, planar sides 13, 14 separated by arcuate sides 15, 16 which are topped by low, rim elevations 17, 18 so as to define therebetween a generally flat top area 19. From the bottom face 10, the block is drilled axially upwardly to form a smooth bore 20 disposed to receive a tubular spindle or standard S, thrust-inserted to terminally abut an end wall 21. A smaller axial bore 22 is extended downward from the top surface 19 into the large bore 20, with a counterbore 23 formed at its entry end. From one planar side 14, an annular bore 24 is extended perpendicularly inward with its end wall 25 spaced a small distance from the smooth bore 20, which separation is traversed by a short axial aperture 26 thus forming a fluid conduit.

One planar face 13 of the housing is drilled and tapped to form a pair of sockets 28, 29 which in assembly receive the lead ends of corresponding bolts 30, 31 which thus traverse and securely attach a fixed jaw 32 having a transverse engagement margin 33 projecting above the flat top 19. The opposite planar face 14 of the body is formed with four (mutually parallel) tapped sockets 34, 35, 36, 37 which are spaced radially outward a small distance from the circumference of the piston bore 24 and located at the respective corners of a theoretical square or rectangle which thus boxes the bore; that is, an extension of the axis of the piston bore 24 passes centrally through the quadrangular pattern formed by the four sockets. The terminally threaded end portions of bolts 38, 39, 40, 41 are received in the respective bores, while their outer, unthreaded lengths loosely traverse corresponding apertures of a longitudinally tiltable jaw plate 42. The lower or more distant pair of bolts 40, 41 each carry a coiled compression spring 43, 44 disposed between a head flange 45, 46 and the outer face of the jaw plate 42.

Figure 4:
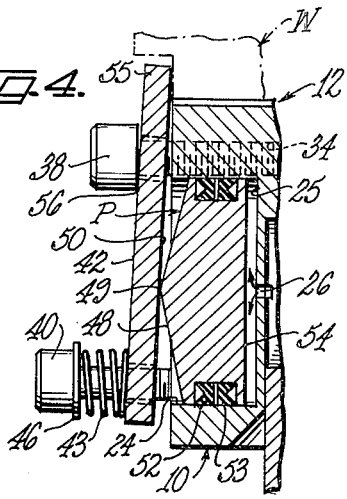
FIG. 4 shows a fragmentary portion of the assembly of FIG. 1, in vertical section, with the movable jaw plate tilted in work-engage position by movement of the piston to the left.
Figure 5:
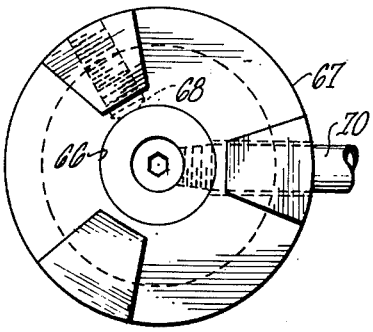
FIG. 5 is a bottom plan view of the spindle mount as seen along line 5—5 of FIG. 1.

A fluid-responsive piston P is located within the bore 24, having an outward facing, conic or pointed contact face 48 of which the apex 49 continually abuts the rear face 50 of the movable jaw. Distal to the conic head is a peripheral groove which is successively occupied by a wiper ring 52 and a compression ring 53, respectively. Thus it will be seen that the rear face 54 of the piston is exposed to fluid forced through the opening 26, the emerging piston sliding the contacted jaw plate 42 tiltingly along the unthreaded portion of the lower bolts 40, 41 in opposition to the force of their expansion springs 43, 44. The upper, projecting, clamping or engagement margin 55 of the jaw plate 42 thus presses the edge of the workpiece W against the opposing margin 33 of the fixed jaw as it pivots on the fulcrum line formed by the peripheral contact points 56 of the inner disc face of the upper bolt heads 38, 39 as seen particularly in FIG. 4. The distance between the piston contact 49 and the fulcrum line through points 56 constitutes an effort arm which is a multiple of the length of the short resistance arm from the plane of 56 to the top edge of the plate where it clamps the workpiece; the mechanical advantage consequently may be considerable and this is obtained without any fixed hinge structure and with the jaw plate being self-aligning (both laterally and longitudinally) on its supporting shafts in response to pressure of the piston P and the springs 43, 44. In addition the fulcrum-supplying bolt heads 38, 39 can be adjusted outwardly if necessary (as well as the lower bolts 40, 41) to accommodate a wider workpiece W. The several bolts may carry a locking element B consisting of a plug of nylon-base or rubbery material compressed lengthwise into a radial channel of the bolt, which plug then expands against the threaded face of the bore; such composite bolts are commercially available under the name "Nyloc".

Figure 3:
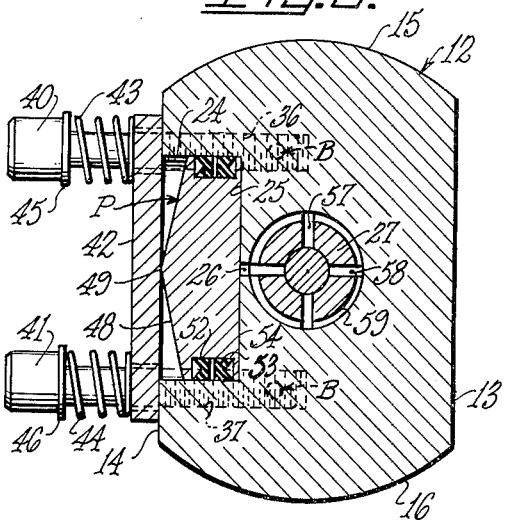
FIG. 3 is a transverse sectional view taken along line 3—3 of FIG. 1.

The particular spindle S here illustrated has a tubular body 27, slit axially downward from its insertion end 51 by a pair of diametric cuts made at 90° arcuate displacement from each other so as to produce the cruciform pattern of slots 57, 58 seen especially in FIG. 3. A peripheral groove 59 is formed in the tube 27 at the level of the aperture 26 so as in effect to keep the rear face 54 of the piston in continuous communication with the axial, fluid channel 60 of the spindle. The channel is also internally threaded downward from its slotted end 51 to provide an attachment socket for a threaded coupling plug T. The latter is formed with a threaded shaft 62 which engages the threaded channel of tube 27 and thus draws the spindle up in the bore 20. A flared head 63 is located in the counterbore 23, its underface having an annular groove in which is lodged a sealing ring 64. A hex socket 65 recessed in its top face enables its manipulation for assembly and disassembly with a tool such as a hex wrench (not shown).

The lower or fixed end of the tubular spindle is anchored in an annular aperture 66 of a support unit 67 and retained by a set screw 68. The bottom of the tubular shaft is closed by a plug 69. A fluid line 70 traverses the support wall and connects the channel 60 with a source of pressurized fluid F, such as a hydraulic pump.

Figure 6:
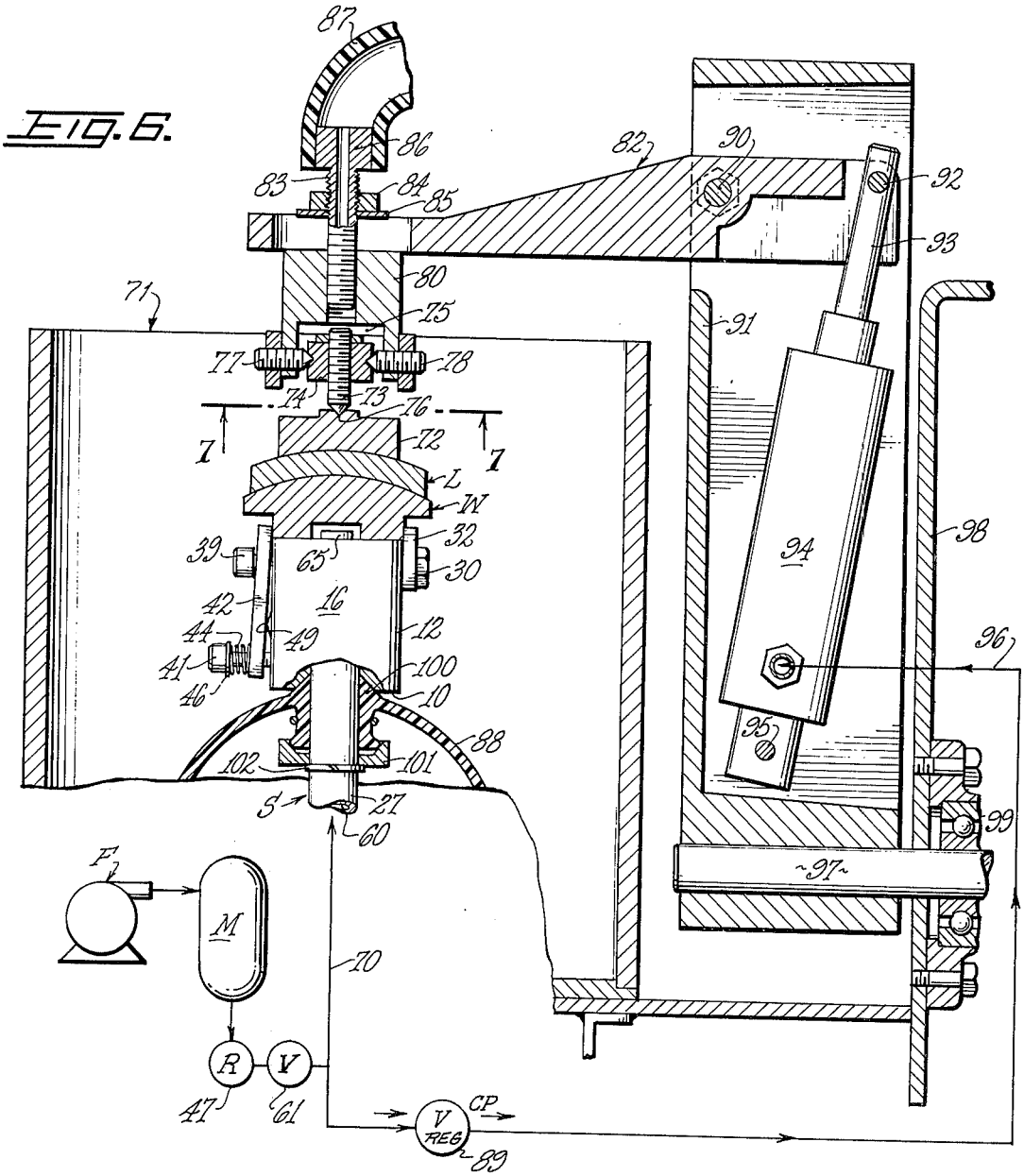
FIG. 6 is a vertical sectional view of a portion of the Lens Grinding and Polishing Unit of applicant's U.S. Pat. No. 3,782,042, with the present chuck in operative position therein, and the fluid connections indicated schematically.

FIG. 6 illustrates use of the present chuck with the particular lens grinding and polishing assembly of applicant's U.S. Pat. 3,782,042. Within an open-top housing well 71, the opposing chuck jaws 32, 42 carried atop the vertical spindle S, by edge-engagement support a lap W against the generally similarly curved underface of a lens blank L which is dependently adhered to a correspondingly curved saddle 72. The latter is held down by action of a pair of downpointed screws 73, 79 which vertically traverse a swinging plate 74 and are anchored thereabove by nuts 75, 81. The screws have their pointed ends received in larger, laterally separated conic sockets 76 of the saddle. The mounting plate 74 is suspended between an opposing pair of pivot pins 77, 78 which thus form a transverse axis for two-dimensional movement of the sub-unit consisting of plate 74, saddle 72 and lens L.

The pivot pins 77, 78 are retained by the dependent bifurcate end of a suspension block 80 which is terminally carried by an overhanging rocker arm 82. The block is held in place by a tubular bolt 83 which vertically traverses an adjustment slot of the arm 82 plus the block 80, being anchored by a nut 84 and washer 85, with its apertured head 86 received within a flexible conduit 87 adapted thus to supply abrasive slurry or cutting oil to the slidingly engaging faces of the lens L and lap W. Spent liquid and suspended solids are ultimately drained off across a flexible dome or shield 88 which protectively overhangs the lower length of the spindle and is formed with a central frusto-conical upward protrusion 100 which is lodged in a corresponding bottom-opening cavity 11, the shield assembly being anchored to the spindle by a supported disc 101 held atop a snap ring 102.

The rocker arm 82 is vertically swingable on a transverse shaft 90 which is carried by the upper end of a hollow housing post 91 with its shorter, inner end pivoted at 92 to the stem 93 of a pneumatic or hydraulic chamber 94 which at its lower end is pivotally attached to the housing 91 by the shaft 95. The fluid chamber 94 is connected to the fluid source F by a conduit 96. Accordingly, extension of the piston stem 93 causes the rocker arm 82 to exert down pressure on the block 80 and its dependently connected lens L.

The housing 91 and its carried units is transversely oscillatable by movement of a horizontal support shaft 97 which is fixedly inserted in the lower end of the housing 91 and extending through the fixed housing wall 98 is journalled in the ball bearing raceway unit 99.

The rocker arm 82 and movable chuck jaw 42 may be operated simultaneously and by the same pressurized fluid (as from the pump F and accumulation reservoir M). The fluid line 96 has a constant pressure regulator valve 89 (which maintains a typical pressure of about 10 to about 50 PSI), and the fluid line 70 has a constant pressure regulator valve 47 (which maintains a typical pressure of about 50 to about 100 PSI). Both lines are activated at the same time by a control valve 61. The latter may have a foot-operated trigger which thus leaves the operator's hands free to place and remove successive blanks L and laps W. For simplicity of claim terminology, both the lens blank and lap are referred to as a "workpiece" since either could be placed above or below the other.

Figure 8:
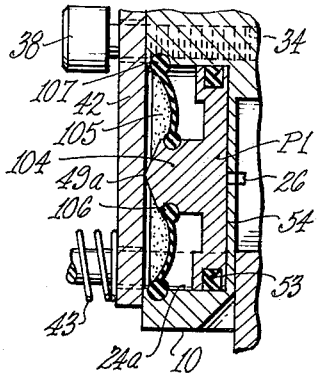
FIG. 8 is a fragmentary vertical sectional view similar to FIG. 4, showing a fluid-responsive piston of different facial configuration and a flexible liquid-tight protective shield secured thereto.
Figure 7:
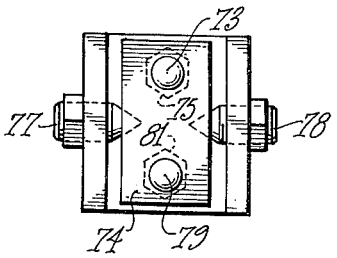
FIG. 7 is a bottom plan view taken along line 7—7 of FIG. 6.

The modification shown in FIG. 8 has its piston P1 formed with a smaller diameter centrally protruding stem 104 ending in a conic or pointed head, of which the apex 49A contacts the rear face of the jaw plate 42, as earlier described. In this form, the wiping ring 52 is omitted and its place is taken by a centrally-apertured, flexible protective disc 105 having a central bead 106 lodged in a corresponding groove of the stem 104. The outer perimeter of the disc has a similar bead 107 which is lodged in a groove of the piston housing 24A. The disc thus flexes as the piston P1 moves in and out, and accordingly shields the piston chamber against abrasive slurry which drains off the lap surface.

I claim:

1. A fluid actuated chuck comprising in combination:

a work support member having work-engaging jaws disposed at opposite sides thereof, which jaws are adapted jointly to hold a workpiece which is located upon the support member, at least one of which jaws is selectively longitudinally tiltable toward and away from the other along a fulcrum line located closely adjacent said workpiece;

said tiltable jaw comprising an apertured plate loosely carried on short outward projecting lengths of four shafts which traverse respective apertures thereof in a generally quadrangular pattern and are terminally anchored in a side of the chuck, which pattern is spaced from said workpiece with two sides of the quadrangle disposed generally parallel thereto;

a fluid responsive piston transversely carried by said chuck, with its axis generally centered within said quadrangular pattern and having a pointed head normally disposed in apical contact with an adjacent face of said plate and thus disposed to tilt the plate into work-engagement position upon piston extension;

and resilient means adapted for work-disengagement by reverse tilting of the plate upon piston retraction, said means being disposed adjacent the more distant pair of shafts and bearing upon the opposite face of said plate.

2. A chuck according to claim 1 in combination with an upright tubular standard on top of which it is mounted, said standard having associated conduit and control means adapted to convey pressurized fluid to the inner face of said piston and thereby operate the tiltable jaw.

3. In a lapping device or the like such as used for finishing opthalmic lenses, which device comprises an elongated, laterally movable spindle terminally disposing a workpiece in opposition to a companion workpiece adjustably and oscillatably pressed thereagainst by an opposing arm for mutual transverse frictional movement of the workpieces with respect to each other, one of which workpieces is a lap, the improvement comprising in combination therewith of:

a work engaging chuck terminally carried by said spindle for selectively retaining its engaged workpiece in functional position, said chuck being characterized by a lever-forming jaw plate, loosely and tiltably disposed along a self-aligning fulcrum line located closely adjacent said workpiece, the longer segment of the plate thus formed on one side of said fulcrum line being responsive to fluid pressure applied thereagainst so as to dispose the shorter segment of the plate located on the other side of the fulcrum line in clamping edge engagement with said workpiece, said jaw plate being apertured and loosely carried on short outward projecting lengths of four shafts which traverse respective apertures thereof in a generally quadrangular pattern and are terminally anchored in a side of the chuck, which pattern is spaced from said workpiece with two sides of the quadrangle disposed generally parallel thereto, said fluid pressure being applied by means of a pointed piston traversely carried by the chuck, having its axis generally centered within said quadrangular pattern with its apex disposed in articulated contact with the jaw plate, fluid responsive means for applying axial-pressure to the companion workpiece by movement of said opposing arm, and control means for simultaneous fluid activation of said arm and jaw plate so as to maintain both of said workpieces in functional engagement.

4. A device according to claim 3 wherein said fluid pressure is pneumatic pressure and said control means includes means for applying different selected pressures respectively to said arm and jaw plate.

5. A chuck having a pair of jaws disposed to releasably engage opposite edges of a workpiece therebetween, at least one of which jaws is selectively movable between work engage and disengage positions and is formed by a lever plate loosely hung upon a spacedapart, generally parallel pair of traversing shafts which jointly provide a fulcrum line closely adjacent and generally parallel to the work engagement edge, which line thus divides the lever plate into a short work engagement arm and a longer leverage arm, means for normally disposing said jaw in work disengaged position, and opposing means comprising a fluid-activated piston disposed in axial point contact with the leverage arm at a position corresponding to a corner of a theoretical triangle of which the other two corners are provided by the respective traversing shafts, whereby the lever plate is laterally and longitudinally tiltingly self-aligning so as to engage the workpiece edge upon operation of the piston.

6. A chuck according to claim 5 which includes means for repetatively applying a preselected fluid pressure to said piston.

* * * * *